United States Patent [19]

McConaghy et al.

[11] 4,178,229

[45] Dec. 11, 1979

[54] PROCESS FOR PRODUCING PREMIUM COKE FROM VACUUM RESIDUUM

[75] Inventors: James R. McConaghy; Paul C. Poynor; John R. Friday, all of Ponca City, Okla.

[73] Assignee: Conoco, Inc., Ponca City, Okla.

[21] Appl. No.: 908,333

[22] Filed: May 22, 1978

[51] Int. Cl.[2] ..... C10G 13/24; C10G 37/02

[52] U.S. Cl. ..... 208/50; 208/56; 208/131

[58] Field of Search ..... 208/50, 56, 131

[56] References Cited

U.S. PATENT DOCUMENTS

| | | | |
|---|---|---|---|
| 2,922,755 | 1/1960 | Hackley | 208/50 |
| 4,090,947 | 5/1978 | Satchell | 208/50 |

*Primary Examiner*—Herbert Levine

*Attorney, Agent, or Firm*—Richard W. Collins

[57] ABSTRACT

Low value heavy hydrocarbonaceous material such as a petroleum refinery vacuum residuum is converted to distillate products and pitch in a hydrogen donor diluent cracking process, and the pitch is utilized as feedstock to a delayed premium coker.

5 Claims, 2 Drawing Figures

PROCESS FOR PRODUCING PREMIUM COKE FROM VACUUM RESIDUUM

BACKGROUND OF THE INVENTION

1. Field of the Invention

This invention relates to a process for upgrading a low value petroleum refinery stream, and more particularly to a process of converting petroleum residuum to distillate products and premium coke.

2. Description of the Prior Art

There are many processes available in the petroleum refining art for upgrading heavy, low value petroleum residual oils. Typical of such low value residual oils is the bottoms fraction from a vacuum distillation tower. Such vacuum distillation towers generally are used to further fractionate virgin atmospheric reduced crude oils. The bottoms fraction from such vacuum distillation columns generally includes all the material boiling above a selected temperature, usually at least 480° C., and often as high as 565° C. In the past, vacuum residuum streams have presented serious disposal problems, as it has been difficult to convert such streams to more valuable products in an economic manner. One method of disposing of vacuum residuum has been to use the stream as feedstock to a fluid bed or delayed coking unit. The resulting coke generally has value only as a cheap fuel. Fluid bed and delayed coking processes for converting vacuum residuum into coke are well known in the petroleum refining industry, and many commercial units utilizing these processes exist.

Another process which is available in the art for upgrading heavy, low value petroleum residual oils is hydrogen donor diluent cracking (HDDC). In this process a hydrogen deficient oil such as vacuum residuum is upgraded by admixing it with a relatively inexpensive hydrogen donor diluent material and thermally cracking the resulting mixture. The donor diluent is an aromatic-naphthenic material having the ability to take up hydrogen in a hydrogenation zone and readily release it to hydrogen deficient hydrocarbons in a thermal cracking zone. The selected donor material is partially hydrogenated by conventional methods using, preferably, a sulfur insensitive catalyst such as molybdenum sulfide, nickel-molybdenum or nickel-tungsten sulfide. Using this process, the heavy oil being upgraded is not directly contacted with a hydrogenation catalyst. Catalyst contamination by the heavy oil is thus avoided. Details of the HDDC process are described in U.S. Pat. Nos. 2,953,513 and 3,238,118.

Delayed coking of vacuum residuum generally produces a coke with a coefficient of thermal expansion (CTE) greater than $20\times10^{-7}$/°C. The CTE of the coke is a measure of its suitability for use in the manufacture of electrodes for electric arc steel furnaces. The lower CTE cokes produce more thermally stable electrodes. Coke which is suitable for manufacture of electrodes for steel furnaces is generally designated as premium or needle coke. The CTE value required for a coke to be designated premium coke is not precisely defined, and there are many other specifications other than CTE which must be met in order for a coke to be designated premium coke. Nevertheless, the most important characteristic, and the one most difficult to obtain, is a suitably low CTE. For example, the manufacture of 61 centimeter diameter electrodes requires CTE values of less than $5\times10^{-7}$/°C., and the manufacture of 41 centimeter diameter electrodes generally requires a coke having a CTE of less than $8\times10^{-7}$/°C. Delayed coking of vacuum residuum from most crudes produces a coke with a CTE of greater than $20\times10^{-7}$/°C., and such cokes, designated regular grade cokes, are not capable of producing a satisfactory large diameter electrode for use in electric arc steel furnaces.

As used herein, the term premium coke is used to define a coke produced by delayed coking which, when graphitized according to known procedures, has a linear coefficient of thermal expansion of less than $8\times10^{-7}$/°C. Preferably, premium coke made according to this invention has a CTE of about $5\times10^{-7}$/°C. or less.

Premium coke is produced commercially by delayed coking of certain refinery streams such as thermal tars, decant oil from a fluidized bed catalytic cracking operation for manufacture of gasoline, pyrolysis tar, blends of these materials, and these materials blended with minor amounts of vacuum residuum or other similar material.

Prior to this invention, there has been no process available which permitted the manufacture of premium coke from vacuum residuum, other than instances where a very small amount of vacuum residuum was blended with a conventional premium coker feedstock.

Premium coke is worth several times as much as regular coke. It is accordingly apparent that any process that can produce premium coke from a low value material such as vacuum residuum is much to be desired, and prior to this invention no such process was available to the industry.

SUMMARY OF THE INVENTION

According to the present invention, a low value heavy hydrocarbonaceous material such as vacuum residuum is upgraded by a hydrogen donor diluent cracking process (HDDC), the effluent from the HDDC process is fractionated, and pitch from the fractionator is utilized as feedstock to a premium coker unit. The term "pitch" as used herein means a bottom stream from a fractionator used to separate distillates and lighter cracked products from the effluent of an HDDC unit, and the pitch typically contains the heavier effluent components along with some material in the gas oil boiling range.

According to one embodiment of the invention, a conventional premium coker feedstock such as thermal tar or decant oil from a fluidized bed catalytic cracking operation is blended with the pitch from the HDDC process to provide a feedstock which produces premium coke.

According to another embodiment, two HDDC stages may be provided prior to the coking step.

Additional modifications and variations will be described in detail below.

DESCRIPTION OF THE PREFERRED EMBODIMENTS

Figure 1:
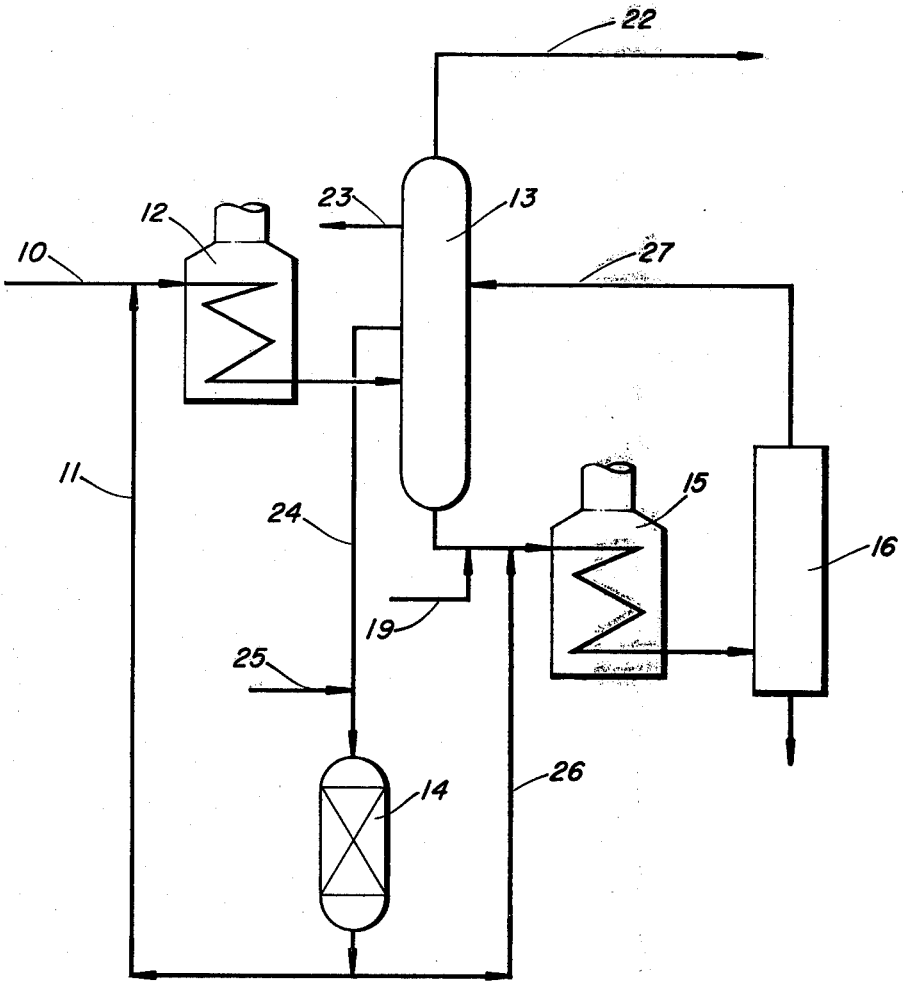
FIG. 1 is a schematic flowsheet illustrating the basic process of the invention.

The basic process of the invention will now be described with reference to FIG. 1 of the drawings. Vacuum residuum feedstock from line 10 is combined with a hydrogen donor diluent from line 11 and fed to a cracking furnace 12 in accordance with the basic HDDC process as known in the art. Furnace 12 typically operates at a temperature of from 480° to 540° C. and a pressure at 10.5 to 70 kg/cm$^2$, preferably about 28 kg/cm$^2$. The furnace effluent passes to a fractionator 13, where gases and distillates are taken off the upper section through lines 22 and 23. A gas-oil fraction is taken off the mid portion of the fractionator through line 24, combined with hydrogen from line 25, and hydrogenated in catalytic hydrotreater 14 for reuse as hydrogen donor diluent in the HDCC process. A portion of the hydrotreated gas-oil from hydrotreater 14 is taken through line 26, combined with the pitch from the bottom of fractionator 13, and passed to a coker furnace 15 where it is heated to coking temperature. Conventional premium coker feedstock can be added through line 19, if desired. The coker furnace effluent is then passed to a delayed coke drum 16 operated at typical conditions suitable for formation of premium coke. Vapors from coke drum 16 are returned through line 27 to the fractionator 13, and premium coke is eventually withdrawn from the bottom of coke drum 16. In this embodiment as described above and illustrated in FIG. 1, premium coke suitable for electrode production for electric arc steel furances can be produced from vacuum residuum. Without the inclusion of the HDDC process, the coke produced from vacuum residuum would be regular grade coke, which has a much lower economic value and different physical properties than the premium coke obtainable by the process illustrated in FIG. 1.

An essential feature of this invention is that the charge to the coker furnace must contain no more than 30 volume percent of material boiling above 510° C. Much of the 510° C.+ material in the vacuum residuum feedstock is cracked to lighter material in the HDDC step, and the pitch from the fractionator contains essentially all of the unconverted 510° C.+ material as well as a considerable amount of heavy gas oil or spent donor boiling in the 340°-510° C. range. Sufficient donor diluent from the hydrotreater is combined with the pitch to provide a coker feed having no more than 30 volume percent 510° C.+ material.

Figure 2:
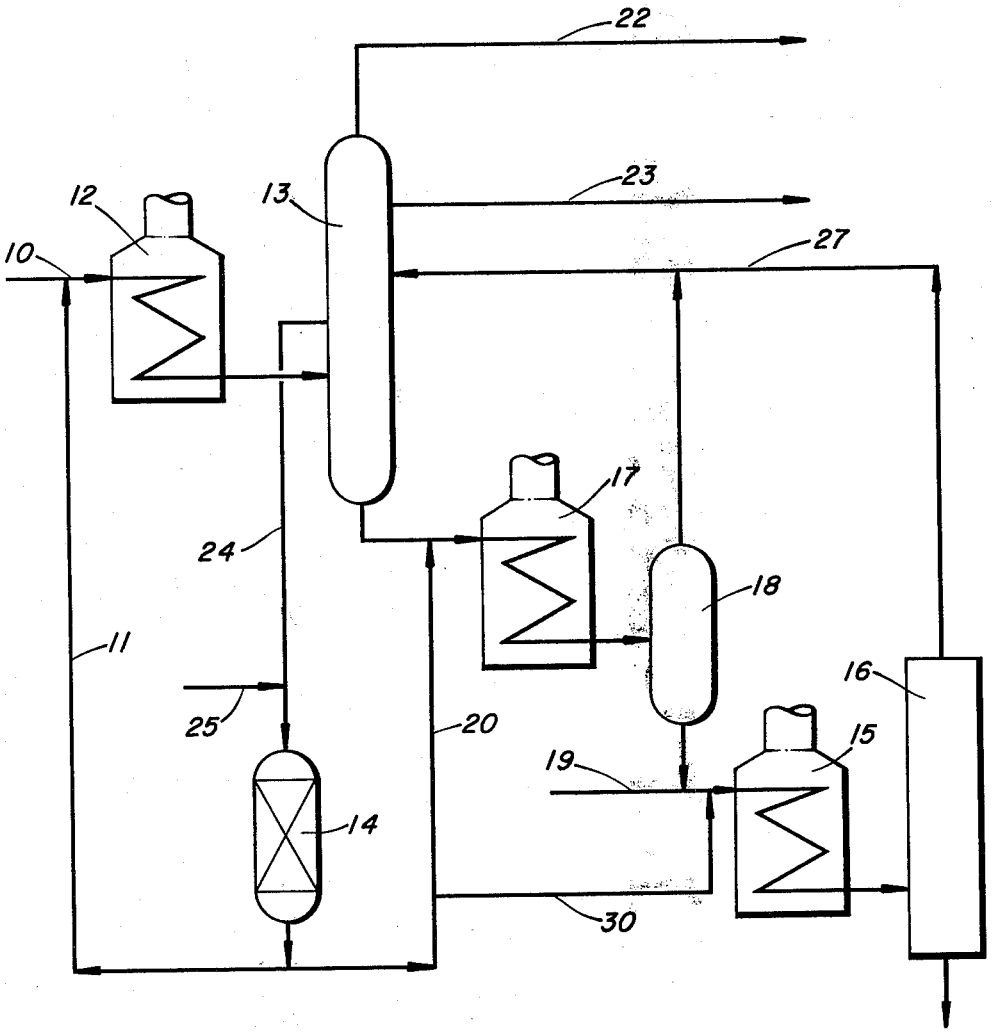
FIG. 2 is a schematic flowsheet illustrating a more elaborate embodiment of the invention.

FIG. 2 illustrates a process similar to that described above with reference to FIG. 1 but with the addition of a second stage cracking furnace 17 and a flash separator 18 between the second stage cracking furnace 17 and the coker furnace 15 to remove light ends from the coker feedstock which might otherwise result in a gas flow rate through the coke drum 16 which is higher than desired. FIG. 2 also shows a line 19 for addition of a conventional premium coker feedstock to the coker furnace feed. As seen in FIG. 2, a first portion of the hydrogen donor diluent, after passing through the hydrotreater 14, is fed through line 20 to the second stage cracking furnace 17, and a second portion is fed through line 30 to the coker furnace 15.

The vacuum residuum utilized as feedstock in this process is the bottoms from a vacuum distillation column such as is used to further fractionate a reduced atmospheric crude. The vacuum residuum includes all of the bottoms material boiling above a selected temperature, which is generally between about 480° and 565° C. The exact cutoff point for the vacuum residuum is influenced by the type of refinery and the needs of the various units within the refinery. Generally, everything that can be distilled from the vacuum column is removed, such that the residuum includes only material which is not practicably distilled. However, as the vacuum residuum can now be converted to a valuable product, the cutoff point may be lowered without adversely affecting the economics of the refining operation, and if the coking capacity is available the residuum might well include all of the material from the vacuum column boiling above about 480° C.

The process of this invention is applicable to heavy hydrocarbonaceous streams other than vacuum resid. Certain heavy crude oils, tar sand bitumens, etc., which contain very little low boiling material, might be used without any pretreatment or after only a light topping operation. It will be appreciated that vacuum resid and similar heavy hydrocarbonaceous material can be coked in a delayed coking operation without first subjecting the material to an HDDC step. However, the coke produced thereby would be low grade or regular coke instead of the valuable premium coke produced by the process of this invention.

The combination of the HDDC process with a delayed coking operation permits production of a valuable premium coke from a low value vacuum residuum feedstock. The combination further permits blending of pitch produced from the HDDC process with conventional premium feedstock to produce premium coke which can have a graphitized CTE even lower than that of premium coke produced from conventional premium coker feedstock alone. This synergistic effect is particularly surprising as one would normally expect the CTE value of a coke produced from a blend of materials to be between the values obtainable by the use of the constituents individually.

The results obtainable according to the process of this invention were demonstrated in a series of pilot plant runs. In each of these runs, the vacuum residuum was taken from a full scale commercial refinery. The pitch was produced using an HDDC pilot plant having two cracking stages, a hydrotreater for hydrogenating a recycle donor diluent stream, and fractionation equipment to separate distillate, recycle donor and pitch fractions from the cracking coil effluent. The pitch produced in the HDDC pilot plant was then coked in a pilot plant coker. The utility of the process, as well as the synergistic effect of a blend of pitch and decant oil, are illustrated in the following example.

EXAMPLE I

In this example, a vacuum residuum was fed to an HDDC pilot plant having a furnace coil temperature of 510° C. and a furnace coil pressure of 28 kg/cm$^2$. A pitch fraction was obtained by fractionation of the cracking furnace effluent. Three coking runs were made in a coker pilot plant under identical coking conditions including a coke drum temperature of 482° C. and a coke drum pressure of 1.76 kg/cm$^2$. In one run, the fresh feed composition to the coker was 100 percent decant oil from a fluidized bed catalytic cracking unit. The decant oil used is a conventional feedstock for a commercial premium coker. A second coker pilot plant run utilized pitch obtained from the HDDC pilot plant run described above. A third coker pilot plant run utilized a blend of equal parts by volume of the HDDC pitch and the decant oil. As seen in Table I below, the CTE of the resulting cokes was within the range required for designation as premium coke. Surprisingly, the CTE of the coke produced from the blend of pitch and decant oil was lower than that for either of the runs utilizing these feedstocks individually. The synergistic effect of utilizing the blend of pitch and decant oil is demonstrated by the fact that the CTE of the coke from this blend was lower than the value obtained utilizing either 100 percent conventional premium coker feedstock or 100 percent HDDC pitch under identical coking conditions. Table I below illustrates this feature.

TABLE I

| Coker Run No. | Fresh Feed Composition | % 510° C.+ Material in Furnace Charge | Product Coke CTE °C.$^{-1}$ |
|---|---|---|---|
| 1 | 100% Decant Oil | 0 | $4.7 \times 10^{-7}$ |
| 2 | 100% Pitch | 22.5 | $5.7 \times 10^{-7}$ |
| 3 | 50% Pitch, 50% Decant Oil | 11.3 | $3.7 \times 10^{-7}$ |

The required feedstock to the process of this invention is heavy liquid hydrocarbonaceous material having an initial boiling point above 340° C. A preferred feedstock is the bottoms fraction from a petroleum refinery vacuum distillation tower having an initial boiling point above 480° C. An optional supplemental feedstock is a conventional premium coker feedstock such as decant oil, thermal tar, pyrolysis tar or combinations of these. The proportion of conventional premium coker feedstock to vacuum tower bottoms in the process depends to some extent on the type of equipment available in the refinery and the coke forming capacity available. It is preferred that at least 20 volume percent, and preferably from 30 to 70 volume percent, of the coker feedstock be pitch derived from the HDDC process. However, the entire coker feedstock can be pitch from the HDDC process and a premium coke is still produced as illustrated in the above example.

The product streams from the process are gases, distillates (primarily those boiling below about 340° C.), and premium coke. Some excess donor may be produced, and can be removed to keep the operation in donor balance.

It will be apparent that numerous variations in flows and equipment could be utilized within the broad aspect of the invention, and the specific arrangements illustrated in the drawings are merely illustrative of the general operation including the combination of an HDDC step and a premium coking step utilizing pitch separated from the HDDC effluent as feedstock to a premium coker. The essential elements of the invention are the HDDC process for cracking vacuum residuum, a means for separating HDDC effluent into product streams including pitch, and a premium coker unit utilizing the pitch as at least a portion of its feedstock. The conditions in the HDDC process and the premium coker process are generally those suitable for either of these operations separately, readily determinable by one skilled in the art without the necessity for experimentation.

The following hypothetical example illustrates the process of the invention as it might be carried out on a commercial scale in a refinery.

A 480° C.+ bottoms stream from a vacuum distillation column is blended with an equal volume of an aromatic gas-oil fraction (hydrogen donor diluent) boiling above 340° C. which has been subjected to mild hydrogenation conditions. The combined vacuum residuum and hydrogenated donor diluent is fed to a cracking furnace having a coil temperature of 510° C. and a coil inlet pressure of 28 kg/cm$^2$. The effluent from the cracking furnace is passed to a fractionator where gases and distillates boiling below 340° C. are recovered, and a stream boiling above 340° C. is removed, blended with hydrogen gas, and passed through a catalytic hydrotreater for reuse as hydrogen donor diluent. The pitch from the bottom of the fractionator, including some 340° C.+ material, is blended with an equal volume of decant oil having a boiling range of from 340°-480° C. and the blended stream then passed to a coker furnace where it is heated to 495° C. and then fed to the bottom of a coke drum. The coke drum is operated at an overhead outlet temperature of 460° C. and a pressure of 1.8 kg/cm$^2$. Overhead vapors from the coke drum are returned to the fractionator, and premium coke is formed in the coke drum. The resulting coke is then removed from the coke drum, calcined and graphitized, and has a CTE of less than $5 \times 10^{-7}$/°C.

The above example is merely illustrative of one embodiment of the invention, and as is clear from the foregoing description and the accompanying drawings, many variations and modifications can be made both in process conditions and equipment without departing from the true scope of the invention.

What is claimed is:

1. A process for producing premium coke comprising:
   (a) subjecting a heavy liquid hydrocarbonaceous material having an initial boiling point above 340° C. to a hydrogen donor diluent cracking operation;
   (b) separating a pitch fraction including substantially all of the 510° C.+ material from the effluent of the hydrogen donor diluent cracking operation, said pitch fraction including part of the gas oil fraction from said effluent;
   (c) passing at least part of the remainder of the gas oil fraction from said effluent to a hydrotreating step to produce a hydrotreated gas oil fraction;
   (d) utilizing a first part of the hydrotreated gas oil fraction as donor diluent in said hydrogen donor diluent cracking operation;
   (e) combining said pitch fraction and a second part of the hydrotreated gas oil fraction to provide a coker feedstock in which the total amount of material boiling above 510° C. in said coker feedstock is not more than 30 volume percent; and
   (f) introducing said coker feedstock to a delayed premium coking operation whereby premium delayed coke is produced.

2. A process for producing premium coke comprising:
   (a) subjecting a heavy liquid hydrocarbonaceous material having an initial boiling point above 340° C. to a first stage hydrogen donor diluent cracking step in a first cracking furnace;
   (b) passing effluent from said first cracking furnace to a fractionator;
   (c) subjecting a pitch fraction from said fractionator to a second stage hydrogen donor diluent cracking step in a second cracking furnace;
   (d) passing a gas oil fraction from said fractionator to a hydrotreater;
   (e) utilizing first and second parts of hydrotreated gas oil from said hydrotreater as donor diluent for said first and second stage hydrogen donor diluent cracking steps;
   (f) combining a third part of hydrotreated gas oil from said hydrotreater with effluent from said second cracking furnace to produce a coker feedstock in which the total amount of material boiling above 510° C. in said coker feedstock is not more than 30 volume percent; and (g) introducing said coker feedstock to a delayed premium coking operation whereby premium delayed coke is produced.

3. The process of claim 2 wherein effluent from said second cracking furnace is passed to a flash separator between said second cracking furnace and said coking operation, the overhead material from said flash separator is combined with overhead vapors from said coking operation and returned to said fractionator, and the bottoms from said flash separator are combined with said third part of said hydrotreated gas oil fraction and fed to said delayed coking operation.

4. The process of claim 1, 2 or 3 wherein a conventional premium coker feedstock is also fed to the delayed coking operation, said conventional premium coker feedstock being selected from the group consisting of thermal tar, decant oil, pyrolysis tar and mixtures thereof, and the amount of said conventional premium coker feedstock being not greater than 80 percent by volume of the total feed stream to said delayed coking operation.

5. The process of claim 1, 2 or 3 wherein said heavy liquid hydrocarbonaceous material is a vacuum reduced crude oil residuum having an initial boiling point of at least 480° C.

* * * * *